US012495872B2

(12) United States Patent
Huang et al.

(10) Patent No.: US 12,495,872 B2
(45) Date of Patent: Dec. 16, 2025

(54) QUICK-ASSEMBLING TROLLEY CASE

(71) Applicant: Jerry Moon, Taipei (TW)

(72) Inventors: He Huang, Dongguan (CN); Liping Yuan, Dongguan (CN); Jerry Moon, Taipei (TW)

(73) Assignee: Jerry Moon, Taipei (TW)

( * ) Notice: Subject to any disclaimer, the term of this patent is extended or adjusted under 35 U.S.C. 154(b) by 119 days.

(21) Appl. No.: 18/632,775

(22) Filed: Apr. 11, 2024

(65) Prior Publication Data

US 2025/0127270 A1 Apr. 24, 2025

(30) Foreign Application Priority Data

Oct. 21, 2023 (CN) ..... 202322827844.0

(51) Int. Cl.
*A45C 5/03* (2006.01)
*A45C 5/14* (2006.01)
*A45C 13/26* (2006.01)

(52) U.S. Cl.
CPC ..... *A45C 5/03* (2013.01); *A45C 5/14* (2013.01); *A45C 13/262* (2013.01); *A45C 2005/037* (2013.01); *A45C 2013/267* (2013.01)

(58) Field of Classification Search
CPC ..... A45C 5/03; A45C 5/14; A45C 13/262; A45C 2005/037; A45C 2013/267
See application file for complete search history.

(56) References Cited

U.S. PATENT DOCUMENTS 5,782,325 A * 7/1998 O'Shea ..... A45C 13/262 16/113.1
6,109,404 A * 8/2000 Bishop ..... A45C 5/14 190/125
6,148,973 A * 11/2000 Chang ..... A45C 5/14 190/115
6,176,357 B1 * 1/2001 Kuo ..... A45C 13/262 190/115
2007/0175719 A1 * 8/2007 Lai ..... A45C 5/02 190/115
2008/0078636 A1 * 4/2008 Lai ..... A45C 5/02 190/127
2008/0142323 A1 * 6/2008 Chen ..... A45C 5/02 190/125

(Continued)

*Primary Examiner* — Tri M Mai
(74) *Attorney, Agent, or Firm* — Rabin & Berdo, P.C.

(57) ABSTRACT

A quick assembling trolley case includes a shell provided at predetermined positions with retaining recesses, mounting recesses, and a receiving recess; a plurality of handle parts including a handle and two handle fixing seats snap-fitted into the retaining recesses; four caster assemblies each including a locating upper cover and a mounting base having a swivel caster connected thereto, which are located at an outer and an inner side, respectively, of the mounting recess and snap-joined together; and a telescopic handle mechanism including a telescopic handle having a grip, two movable rods, and two guiding sleeves fitted on around the movable rods and being connected at upper and lower ends to an upper fixing assembly and a lower fixing assembly, which are snap-fitted onto the receiving recess and a lower portion of the shell, respectively. With the above arrangements, the trolley case can be easily and efficiently assembled.

8 Claims, 12 Drawing Sheets

(56) References Cited

U.S. PATENT DOCUMENTS

| | | | | |
|---|---|---|---|---|
| 2013/0008753 | A1* | 1/2013 | Moon | A45C 13/36<br>190/115 |
| 2013/0092490 | A1* | 4/2013 | Moon | A45C 7/0031<br>190/18 A |
| 2020/0352299 | A1* | 11/2020 | Rubio | A45C 5/03 |

* cited by examiner

QUICK-ASSEMBLING TROLLEY CASE

FIELD OF THE INVENTION

The present invention relates to the field of trolley case, and more particularly, to a quick assembling trolley case.

BACKGROUND OF THE INVENTION

A trolley case is a suitcase with a telescopic handle, side handles, and casters and is widely adopted due to its convenience for use. The telescopic handle, side handles, and casters of the currently available trolley case are basically mounted to a shell of the case using screws. Therefore, the existing trolley case involves complicate manufacturing procedures and requires a lot of labor, which result in high labor cost and low production efficiency of the current trolley case.

SUMMARY OF THE INVENTION

A primary object of the present invention is to provide a quick assembling trolley case that can be assembled easily with less labor and increased assembling efficiency.

To achieve the above and other objects, the quick assembling trolley case according to the present invention includes a shell, a plurality of handle parts, four caster assemblies, and a telescopic handle mechanism. The handle parts includes a handle and two handle fixing seats connected to two ends of the handle, such that the handle is assembled between the two handle fixing seats; and a plurality of surfaces of the shell are provided with two retaining recesses that are corresponding to the handle fixing seats, so as the retaining recesses are snap-fitted by the handle fixing seats;

Each of the caster assemblies includes a wheel and a locating upper cover; and the wheel includes a mounting base and a swivel caster mounted to the mounting base. The shell is provided at each of four bottom corners with a mounting recess matching the mounting base; and the mounting base and the locating upper cover are respectively located at an inner side and an outer side of the mounting recess for being snap-joined with each other through the a wall of the mounting recess. The telescopic handle mechanism includes a telescopic handle, an upper fixing assembly, and a lower fixing assembly. The upper fixing assembly includes an outer fixing plate and a first inner fixing plate. A surface of the shell is provided with a receiving recess corresponding to the outer fixing plate. The outer fixing plate and the first inner fixing plate are respectively located in front of and behind the receiving recess for being snap-joined with each other via a wall of the receiving recess. The lower fixing assembly includes a second inner fixing plate and a plurality of outer fixing strips. The second inner fixing plate and the outer fixing strips are respectively located at an inner side and an outer side of the shell for being snap-joined with each other through a wall of the shell. The telescopic handle includes a grip, two movable rods connected to two ends of the grip, and two guiding sleeves externally fitted on around the movable rods. Two lateral ends of the outer fixing plate are provided with a guiding hole respectively, and the guiding holes extend through the outer fixing plate and match the guiding sleeves. Two lateral ends of the receiving recess have a through hole corresponding to the guiding holes respectively, and two lateral ends of the second inner fixing plate is provided with a locating hole respectively.

The guiding sleeves have their bottom ends passing through the through holes and the guiding holes to insert into the locating holes.

Preferably, each of the two handle fixing seats is provided at two opposite end surfaces with a first slant surface and a second slant surface; both of the first slant surface and the second slant surface are externally provided with a snap-fit recess, and each of the retaining recesses is provided with two first snap-fit protrusions on two opposing end walls for snapping joined to the snap-fit recess. Each of the two handle fixing seats is further provided at two opposite side surfaces with a guiding groove, two opposing walls of retaining recesses are provided with a first guiding plate corresponding to the guiding groove; and the first guiding plate are located in and movably relative to the guiding groove.

Preferably, each of the locating upper covers is provided on an inner side with a plurality of insertion members, and a wall surface of the mounting recesses on the shell is provided with a plurality of first penetrating slots at positions corresponding to the insertion members. Each of the mounting bases is provided with a plurality of retaining members corresponding to the first penetrating slots, and each of the retaining members is provided with a penetrating insertion slot matching the insertion member. An end of the insertion member is provided at two opposite sides with a plurality of second snap-fit protrusions, the second snap-fit protrusions sequentially pass through the first penetrating slots and the penetrating insertion slots to be retained to the penetrating insertion slots.

Preferably, the outer fixing plate of the telescopic handle mechanism includes a first bottom portion matching a configuration of the receiving recess, and a first side portion extended from one side of the first bottom portion. The first side portion is parallelly provided on an inner side surface with a plurality of third snap-fit protrusions, and the first bottom portion has an underside located adjoining a wall surface in the receiving recess. The surfaces of the shell are provided with a yield recess communicable with the receiving recess and the first side portion is located in the yield recess. The wall of the yield recess is provided with second penetrating slots corresponding to the third snap-fit protrusions. The first inner fixing plate includes a second bottom portion matching a configuration of an outer wall of the receiving recess, and a second side portion extended from one side of the second bottom portion. The second bottom portion has an underside located adjoining a wall surface outside the receiving recess and the second side portion is provided with a plurality of first penetrating retaining slots corresponding to the second penetrating slots; and the third snap-fit protrusions on the first side portion of the outer fixing plate being inserted through the second penetrating slots on yield recess of the shell to be retained to the first penetrating retaining slots on the second side portion of the first inner fixing plate.

Preferably, the second inner fixing plate of the telescopic handle mechanism includes a third bottom portion matching a configuration of an inner wall surface of the shell. Two connecting portions are symmetrically provided at two lateral ends of the third bottom portion; the locating hole is disposed on a top of the connecting portions. An inner side surface of the outer fixing strips is provided at each of two ends with a fourth snap-fit protrusion, and the shell is provided at positions corresponding to the fourth snap-fit protrusions with a plurality of third penetrating slots. The third bottom portion is provided with second penetrating retaining slots corresponding to the third penetrating slots, and the fourth snap-fit protrusions extend through the third penetrating slots to be retained to the second penetrating retaining slots on the third bottom portion.

Preferably, the first bottom portion is provided at two lateral ends with a guiding channel body, and the receiving recess is penetrated to form a horizontal penetrating slot that extends to the yield recess, so as the guiding channel is assembled with the horizontal penetrating slot. The second bottom portion is provided on a top near each of two lateral ends with a recessed horizontal push groove that extends to the second side portion and is located corresponding to the guiding channel bodies, and the guiding channel bodies are movably located on the horizontal push grooves. The guiding channel bodies are respectively provided on a bottom with a penetrating elongated slot, and the horizontal push grooves being respectively provided on a top with a second guiding plate corresponding to the penetrating elongated slots, such that the second guiding plates are movably engaged with the elongated guiding slots. Further, the second guiding plates are respectively provided on a top with a limiting plate, which are movably set in the guiding channel bodies.

Preferably, each of the handle fixing seats includes a top plate provided with a penetrating passage, and a fitting barrel connected to a lower side of the top plate, and two opposite side walls of the fitting barrel are provided with a wedge-shaped movement slot. The handle is provided on a lower side at two opposite ends with a connecting lug each, each of the connecting lugs is provided with a through pin hole, and the through pin hole is connected between two wedge-shaped movement slots via a shaft pin.

Preferably, the surface of the shell is provided with an elongated yield recess located between the two retaining recesses.

With the quick assembling trolley case of the present invention, the handle parts can be assembled to the shell simply by snap-fitting the two handle fixing seats into corresponding retaining recesses; each of the caster assemblies can be assembled to the shell simply by positioning the locating upper cover and the mounting base on the outer and the inner side of the mounting recess and snap-joining them with each other; the telescopic handle mechanism can be assembled to the shell simply by positioning the second inner fixing plate and the outer fixing strips of the lower fixing assembly on the inner and the outer side of the lower portion of the shell and then snap-joining them with each other; and then positioning the first inner fixing plate and the outer fixing plate of the upper fixing assembly behind and in front of the receiving recess and then snap-joining them together; such that the guiding holes on the outer fixing plate, the through holes on the receiving recess, and the locating holes on the second inner fixing plate are aligned with one another, allowing the telescopic handle to extend there through and be quickly assembled to the shell. The quick assembling trolley case of the present invention has simple structure and can be conveniently assembled without the need of using a large number of screws to fasten the handle, the wheels and the telescopic handle in place. Since the trolley case of the present invention is easy to assemble, it can be produced at reduced labor cost and increased production efficiency.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein

FIG. 10 is a fragmentary, enlarged, partially sectioned view of the circled area D in

FIG. 2;

DETAILED DESCRIPTION OF THE PREFERRED EMBODIMENTS

Figure 1:
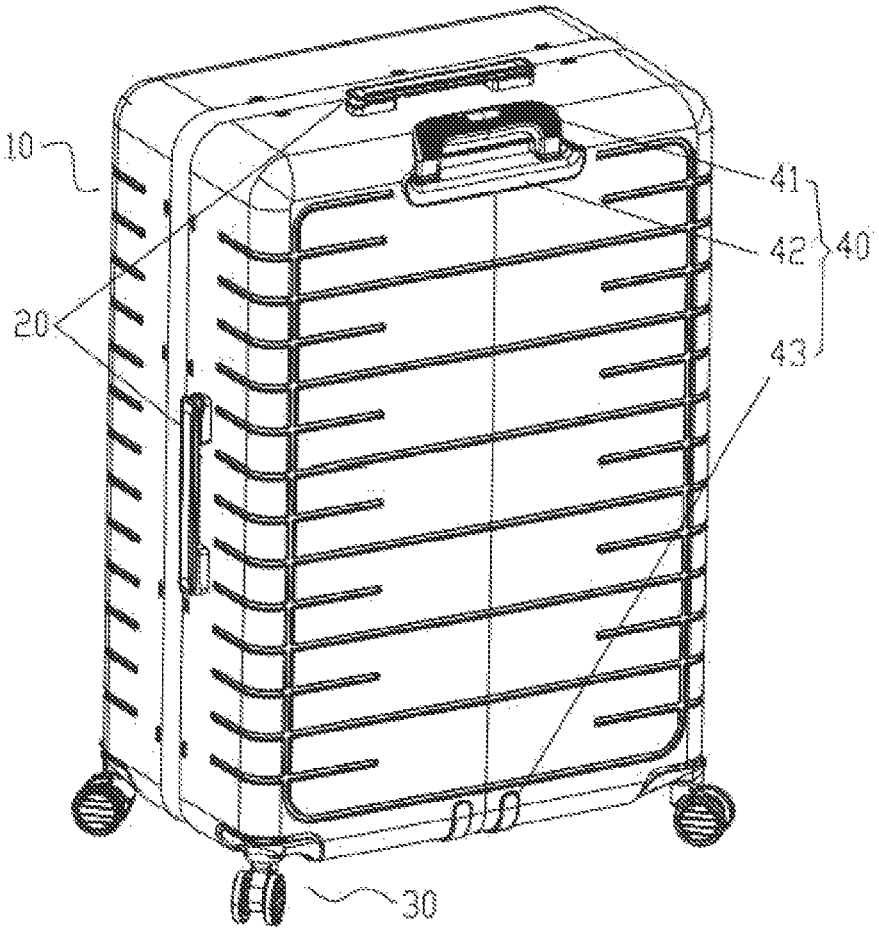
FIG. 1 is an assembled perspective structural view showing an appearance of a quick assembling trolley case according to a preferred embodiment of the present invention.

The objects, technical means and advantages of the present invention will now be described clearly and completely with a preferred embodiment thereof by referring to the accompanying drawings. It is understood the described embodiment is only a part of the embodiments of the present invention instead of all.

It is understood other embodiments that may be carried out by a person of generally skill in the art on the basis of the illustrated preferred embodiment of the present invention without exercising inventive skill all fall in the scope of the present invention that is intended to be protected.

Please refer to FIGS. 1 to 12. The present invention provides a quick assembling trolley case 1, which includes a shell 10, a plurality of handle parts 20, four caster assemblies 30, and a telescopic handle mechanism 40. The handle parts include a handle 21 and two handle fixing seats 22 connected to two ends of the handle 21, such that the handle 21 is assembled to between the two handle fixing seats 22. The shell 10 has retaining recesses 11 provided on its top surface at positions corresponding to the handle fixing seats 22, such that the handle fixing seats 22 are snap-fitted into the retaining recesses 11. Each of the four caster assemblies 30 includes a wheel 31 and a locating upper cover 32. The wheel 31 includes a mounting base 310 and a swivel wheel caster 312 mounted to the mounting base 310. The shell 10 is provided at four bottom corners with a mounting recess 12 each, which matches the mounting base 310. The mounting base 310 and the locating upper cover 32 are located at an inner side and an outer side of the mounting recess 12, respectively, and are snap-joined to each other through a wall of the mounting recess 12. The telescopic handle mechanism 40 includes a telescopic handle 41, an upper fixing assembly 42, and a lower fixing assembly 43.

The upper fixing assembly 42 includes an outer fixing plate 420 and a first inner fixing plate 421. The shell 10 is provided on its top surface with a receiving recess 13 that matches the outer fixing plate 420. The outer fixing plate 420 and the first inner fixing plate 421 are located in front of and behind the receiving recess 13, respectively, and are snap-joined to each other through a wall of the receiving recess 13. The lower fixing assembly 43 includes a second inner fixing plate 430 and a plurality of outer fixing strips 431. The second inner fixing plate 430 and the outer fixing strips 431 are located at an inner side and an outer side of the shell 10, respectively, and are snap-joined to each other through the wall of the shell 10. The telescopic handle 41 includes a grip 410, two movable rods 411 connected to two ends of the grip 410, and two guiding sleeves 412 fitted on around outer sides of the two movable rods 411. The outer fixing plate 420 is provided at two lateral ends with a guiding hole 420*a* each, which extends through the outer fixing plate 420 and matches the guiding sleeves 412. The receiving recess 13 has two through holes 130 provided at two lateral ends corresponding to the locating hole 420*a*. The second inner fixing plate 430 is provided at two lateral ends with a locating hole 430*a* each; and bottom ends of the guiding sleeves 412 pass through the through holes 130 on the receiving recess 13 and the guiding holes 420*a* on the outer fixing plate 420 to insert into the locating holes 430*a*.

To assemble the handle parts 20, first fit the two handle fixing seats 22 in the two retaining recesses 11 to achieve quick assembling of the handle parts 20 to the shell 10. To assemble the caster assemblies 30, first place the mounting base 310 and the locating upper cover 32 of each of the caster assemblies 30 on the inner and the outer side of the corresponding mounting recess 12, and then snap-join the locating upper cover 32 with the mounting base 310 to achieve quick assembling of the caster assemblies 30 to the shell 10. To assemble the telescopic handle mechanism 40, first connect the second inner fixing plate 430 and the outer fixing strips 431 of the lower fixing assembly 43 to a lower inner side and a lower outer side of the shell 10, respectively; and then place the first inner fixing plate 421 and the outer fixing plate 420 of the upper fixing assembly 42 behind and in front of the receiving recess 13, respectively, and snap-join the first inner fixing plate 431 with the outer fixing plate 420. At this point, the guiding holes 420*a* of the upper fixing assembly 42, the through holes 130 on the receiving recess 13, and the locating holes 430*a* of the lower fixing assembly 43 are located in alignment with one another. Thereafter, insert the two guiding sleeves 412 of the telescopic handle 41 through the aligned guiding holes 420*a* and through holes 130 into the locating holes 430*a* to achieve quick assembling of the telescopic handle 41 to the shell 10. Since the trolley case of the present invention has simple structure, it can be easily assembled with reduced labor cost and increased production efficiency.

In the above described preferred embodiment, each of the two handle fixing seats 22 is provided at two opposite end surfaces with a first slant surface 220 and a second slant surface 221. Both the first and the second slant surface 220, 221 are externally provided with a snap-fit recess 222, and each of the retaining recesses 11 is provided on two opposing end walls with a first snap-fit protrusion 113 each for snap-joining with the snap-fit recess 222. Each of the two handle fixing seats 22 is further provided at two opposite side surfaces with a guiding groove 223 each, and each of the retaining recesses 11 is provided on two opposing side walls with a first guiding plate 110 each corresponding to the guiding groove 223, such that the first guiding plates 110 are located in and movable relative to the guiding grooves 223. Specifically, when assembling the handle parts 20, the handle fixing seats 22 are aligned with and pressed into the retaining recesses 11, such that the guiding grooves 223 are guided by the first guiding plates 110 to move while the first and the second slant surfaces 220, 221 are moved to press against the first snap-fit protrusions 113 provided on the two opposing end walls of the retaining recesses 11 until the first snap-fit protrusions 113 in the retaining recesses 11 and the snap-fit recesses 222 on the handle fixing seats 22 are snap-joined together. At this point, the handle fixing seats 22 are located in and assembled to the retaining recesses 11 to complete the assembling of the handle parts 20.

Figure 10:
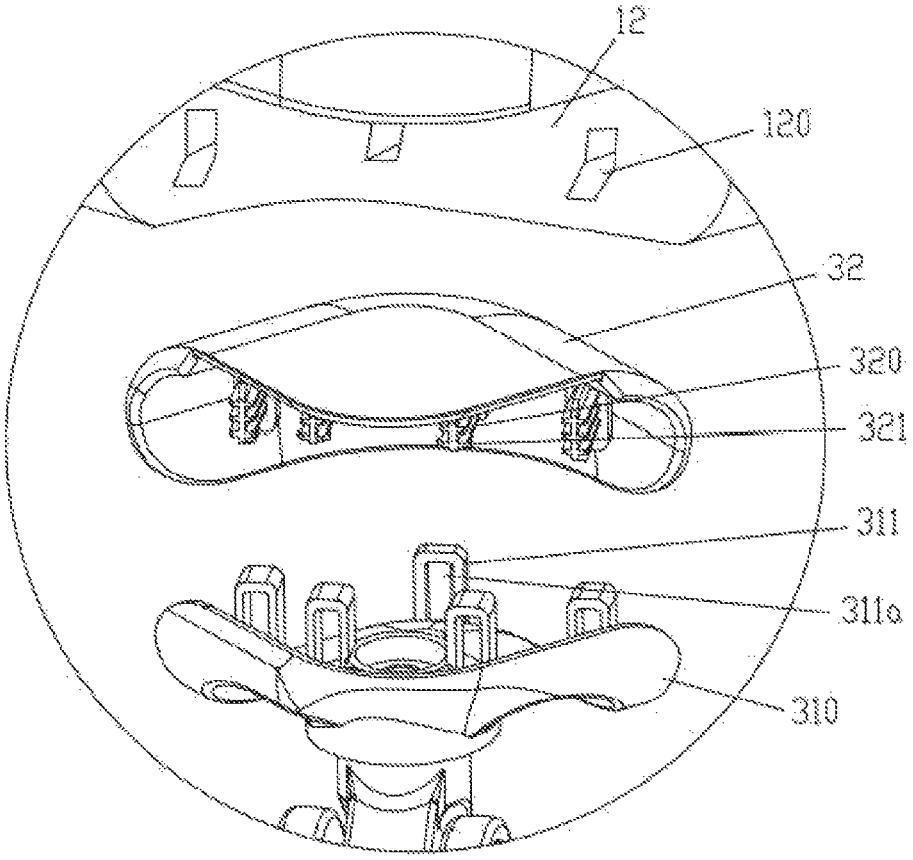
Figure 11:
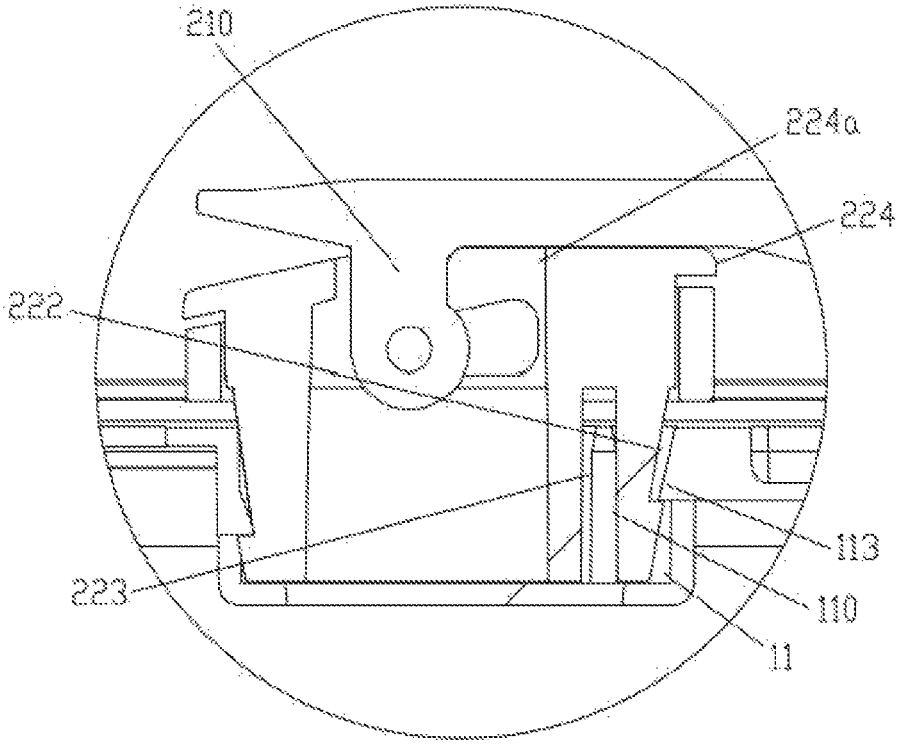
FIG. 11 is a fragmentary enlarged view of the circled area E in FIG. 3.
Figure 12:
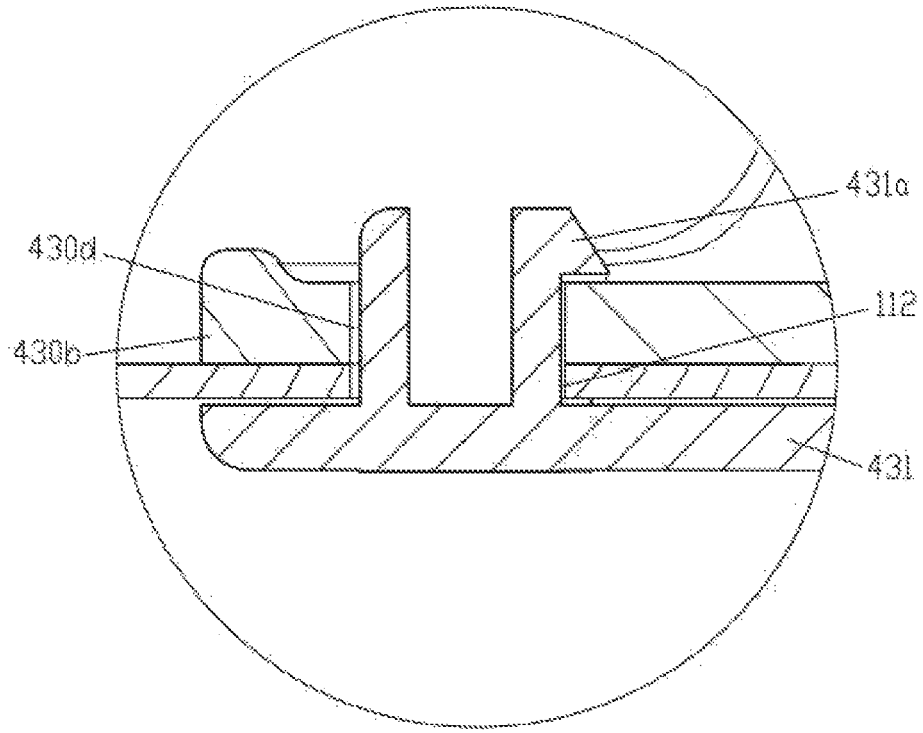
FIG. 12 is a fragmentary enlarged sectional view of the circled area F in FIG. 4.

Please refer to FIG. 10. In the above described embodiment, each of the locating upper covers 32 of the caster assemblies 30 is internally provided with a plurality of insertion members 320, and each of the mounting recesses 12 is provided on its wall with a plurality of first penetrating slots 120 at positions corresponding to the insertion members 320. Each of the mounting bases 310 is provided with a plurality of retaining members 311 corresponding to the first penetrating slots 120, and each of the retaining members 311 defines a penetrating insertion slot 311*a*, which matches the insertion member 320. The insertion member 320 has an end that is provided at two opposite sides with a plurality of second snap-fit protrusions 321, which sequentially pass through the first penetrating slots 120 and the penetrating insertion slots 311*a* to be retained to the penetrating insertion slots 311*a*. Specifically, when assembling the wheel 31 to the shell 10, the locating upper cover 32 is assembled to the wall of the mounting recess 12 from the inner side of the shell 10 by extending the insertion members 320 through corresponding first penetrating slots 120. And, the mounting base 310 is assembled to the mounting recess 12 while the locating upper cover 32 is held in place, so that the insertion members 320 can pass through the corresponding penetrating insertion slots 311*a* with the second snap-fit protrusions 321 being retained to the penetrating insertion slots 311*a* to achieve quick assembling of the wheel 31 to the shell 10.

Figure 6:
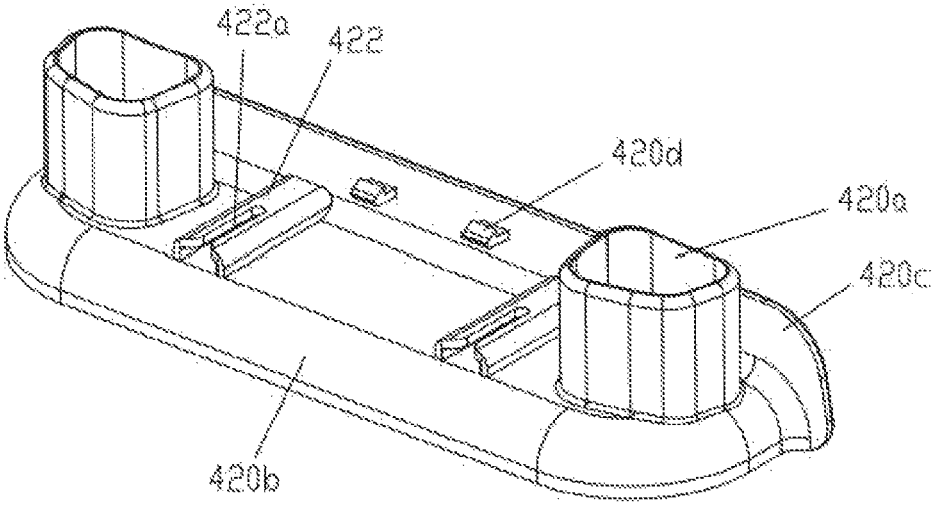
FIG. 6 is an upside-down perspective structural view of an outer holding plate for the quick assembling trolley case of the present invention.
Figure 7:
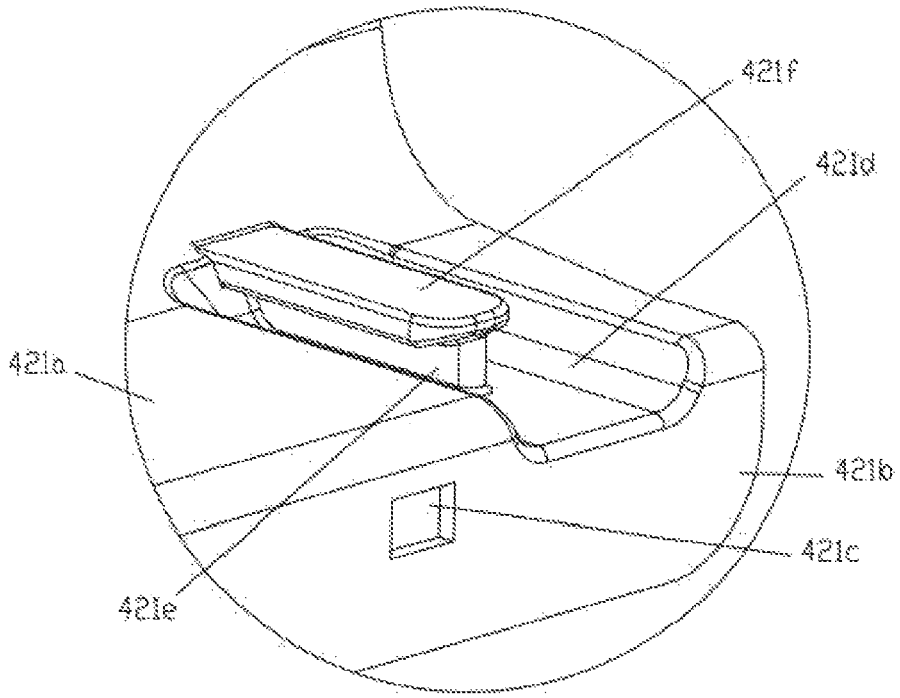
FIG. 7 is a fragmentary enlarged perspective view of the circled area A in FIG. 2.
Figure 8:
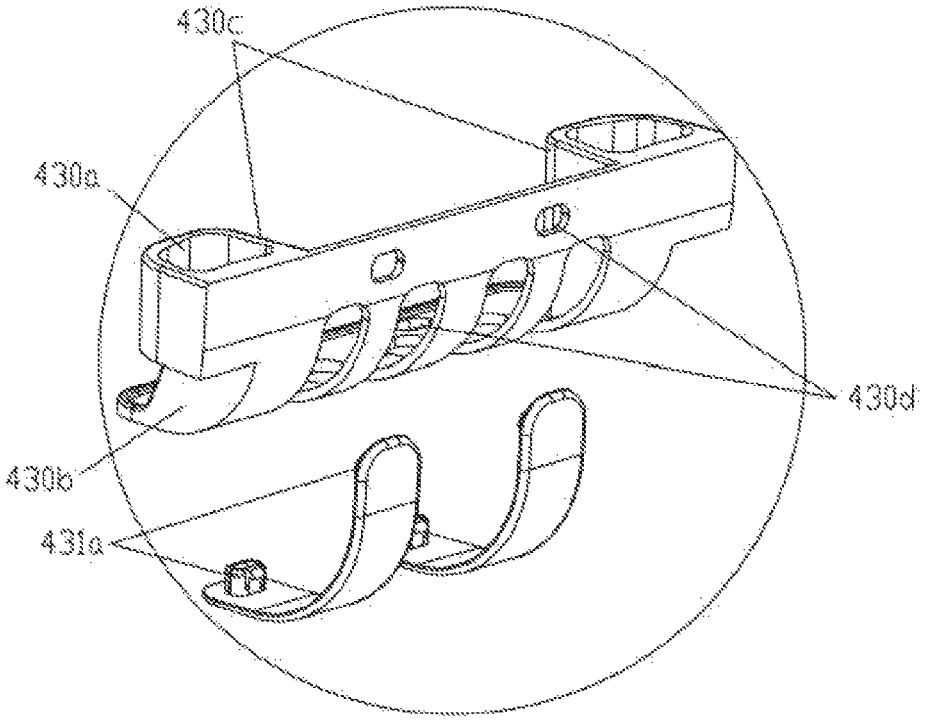
FIG. 8 is a fragmentary enlarged perspective view of the circled area B in FIG. 2.
Figure 9:
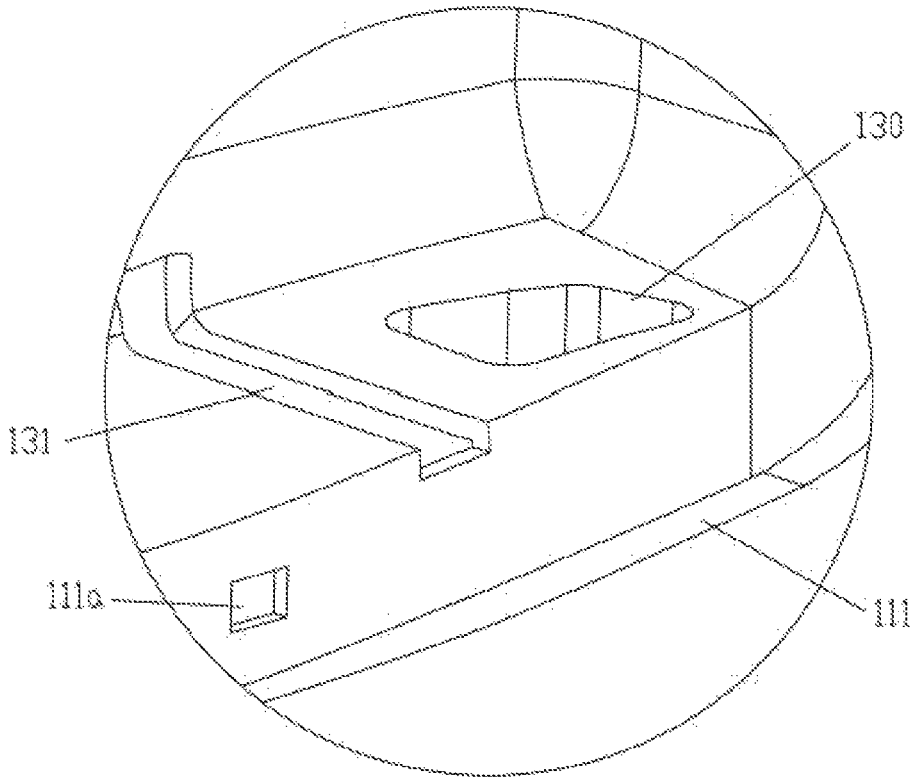
FIG. 9 is a fragmentary enlarged perspective view of the circled area C in FIG. 2.

Please refer to FIG. 6, which is an upside-down view of the outer fixing plate 420 in the above described embodiment. As shown, the outer fixing plate 420 includes a first bottom portion 420*b* having a configuration matching that of the receiving recess 13, and a first side portion 420*c* downward connected to one side of the first bottom portion 420*b*. The first side portion 420*c* is provided on an inner side surface with a plurality of parallelly arranged third snap-fit protrusions 420*d*. Please refer to FIGS. 2, 6 and 9 at the same time. An underside of the first bottom portion 420*b* is located adjoining an inner wall surface of the receiving recess 13; and the shell 10 is provided on its top surface with a yield recess 111 communicable with the receiving recess 13, and the first side portion 420*c* is located in the yield recess 111. The yield recess 111 is provided on its wall with second penetrating slots 111*a* corresponding to the third snap-fit protrusions 420*d*. Please refer to FIGS. 2, 4 and 7. The first inner fixing plate 421 includes a second bottom portion 421*a* having a configuration matching that of an outer wall surface of the receiving recess 13, and a second side portion 421*b* downward connected to one side of the second bottom portion 421*a*. The second bottom portion 421*a* has an inner upper side located adjoining to the outer wall surface of the receiving recess 13, and the second side portion 421*b* is provided with a plurality of first penetrating retaining slots 421*c* corresponding to the second penetrating slots 111*a*. The third snap-fit protrusions 420*d* extend through the second penetrating slots 111*a* to be retained to the first penetrating retaining slots 421*c*. Specifically, when assembling the outer fixing plate 420 to the receiving recess 13, the underside of the first bottom portion 420*b* is attached to the inner wall surface of the receiving recess 13, the first penetrating side portion 420*c* is engaged with the yielding recess 111, and the third snap-fit protrusions 420*d* are inserted through the corresponding second penetrating slots 111*a* into the shell 10. Then, the first inner fixing plate 421 is assembled to the outer wall surface of the receiving recess 13 from the inner side of the shell 10, so that the second bottom portion 421*a* is attached to the outer wall surface of the receiving recess 13. When the first inner fixing plate 421 is pushed forward horizontally, the third snap-fit protrusions 420*d* are engaged with the corresponding first penetrating retaining slots 421*c*, so that the outer fixing plate 420 and the first inner fixing plate 421 are snap-joined together to achieve the assembling of the upper fixing assembly 42 to the shell 10.

In the above described embodiment, as shown in FIGS. 2, 4, 8, and 12, the second inner fixing plate 430 includes a third bottom portion 430*b* having a configuration matching that of an inner wall surface of the shell 10, two connecting portions 430*c* symmetrically provided at two lateral ends of the third bottom portion 430*b* with the locating hole 430*a* formed on a top of each of the connecting portions 430*c*, and two fourth snap-fit protrusions 431*a* provided on two ends of the inner side surface of each of the outer fixing strips 431. The shell 10 is provided at positions corresponding to the fourth snap-fit protrusions 431*a* with third penetrating slots 112; the third bottom portion 430*b* is provided at positions corresponding to the third penetrating slots 112 with a second penetrating retaining slot 430*d* each; and the fourth snap-fit protrusions 431*a* extend through the third penetrating slots 112 to be retained to the second penetrating retaining slots 430*d* (see FIG. 12). Specifically, when assembling the second inner fixing plates 430 to the inner wall surface of the shell 10, the third bottom portion 430*b* is attached to the inner wall surface of the shell 10 with the penetrating second penetrating retaining slots 430*d* aligned with the third penetrating slots 112 on the shell 10; and then, attach the outer fixing strips 431 to the outer wall surface of the shell 10 with the fourth snap-fit protrusions 431*a* extended through the third penetrating slots 112 to be retained to the corresponding penetrating second penetrating retaining slots 430*d*, so that the outer fixing strips 431 are snap-joined with the second inner fixing plate 430 to achieve the assembling of the lower fixing assembly 43 to the shell 10.

In the above described embodiment, as shown in FIGS. 2, 6, 7 and 9, the first bottom portion 420*b* is provided on its bottom side near two lateral ends with a guiding channel body 422 each, and the receiving recess 13 is provided with horizontal slots 131 penetrating the wall of the receiving recess 13 and extending to the yield recess 111, such that the guiding channel bodies 422 are located above the horizontal slots 131. The second bottom portion 421*a* is provided on a top near two lateral ends with a recessed horizontal push groove 421*d* each, which extends to the second side portion 421*b* and is located corresponding to the guiding channel bodies 422, and the guiding channel bodies 422 are movably located on the horizontal push grooves 421*d*. Each of the guiding channel bodies 422 is provided on a bottom with an elongated guiding slot 422*a* that penetrates the bottom of the guiding channel body 422, and each of the horizontal push grooves 421*d* is provided on a top with a second guiding plate 421*e*, which matches with and is movably set in the elongated guiding slot 422*a*. Each of the second guiding plates 421*e* is provided on a top with a limiting plate 421*f*, which is movably set in the guiding channel body 422. Specifically, when assembling the outer fixing plate 420 to the receiving recess 13, the guiding channel bodies 422 are located above the horizontal penetrating slots 131, and the elongated guiding slots 422*a* and the horizontal penetrating slots 131 are communicable with the inner side of the shell 10. When assembling the first inner fixing plate 421 to the outer wall surface of the receiving recess 13, first align the second guiding plates 421*e* and the limiting plates 421*f* with inner sides of the elongated guiding slots 422*a* and the guiding channel bodies 422, respectively, and push the first inner fixing plate 421 horizontally to move the same forward, so that the second guiding plates 421*e* and the limiting plates 421*f* are moved through the horizontal penetrating slots 131 into the elongated guiding slots 422*a* and the guiding channel bodies 422, respectively. The horizontal push grooves 421*d* move along the bottoms of the guiding channel bodies 422 until the third snap-fit protrusions 420*d* is retained to the first penetrating retaining slots 421*c*. This arrangement provides a guiding effect, enabling stable assembling of the outer fixing plate 420 to the first inner fixing plate 421 and preventing the upper fixing assembly 42 from moving on and relative to the shell 10.

In the above described embodiment, as shown in FIGS. 2, 3, 4, 5 and 11, each of the handle fixing seats 22 includes a top plate 224 and a fitting barrel 225 connected to a lower side of the top plate 224. The top plate 224 is provided with a passage 224*a* that penetrates the top plate 224, and the fitting barrel 225 is provided on two opposite side walls with a wedge-shaped movement slot 225*a* each. The handle 21 is provided on a lower side at two opposite ends with a connecting lug 210 each, which is provided with a through pin hole. The connecting lugs 210 are connected to the two wedge-shaped movement slots 225*a* by extending shaft pins through the through pin holes and the wedge-shaped movement slots 225. Specifically, when assembling the handle 21 to the handle fixing seats 22, first extend the connecting lugs 210 through the passages 224*a* into the fitting barrels 225 and use shaft pins to connect the connecting lugs 210 to the wedge-shaped movement slots 225*a*. When using the handle 21, the shaft pins are movable in the wedge-shaped movement slots 225*a* to facilitate easy deformation of the handle 21 in use, so that the handle 21 is comfortable for use.

Figure 2:
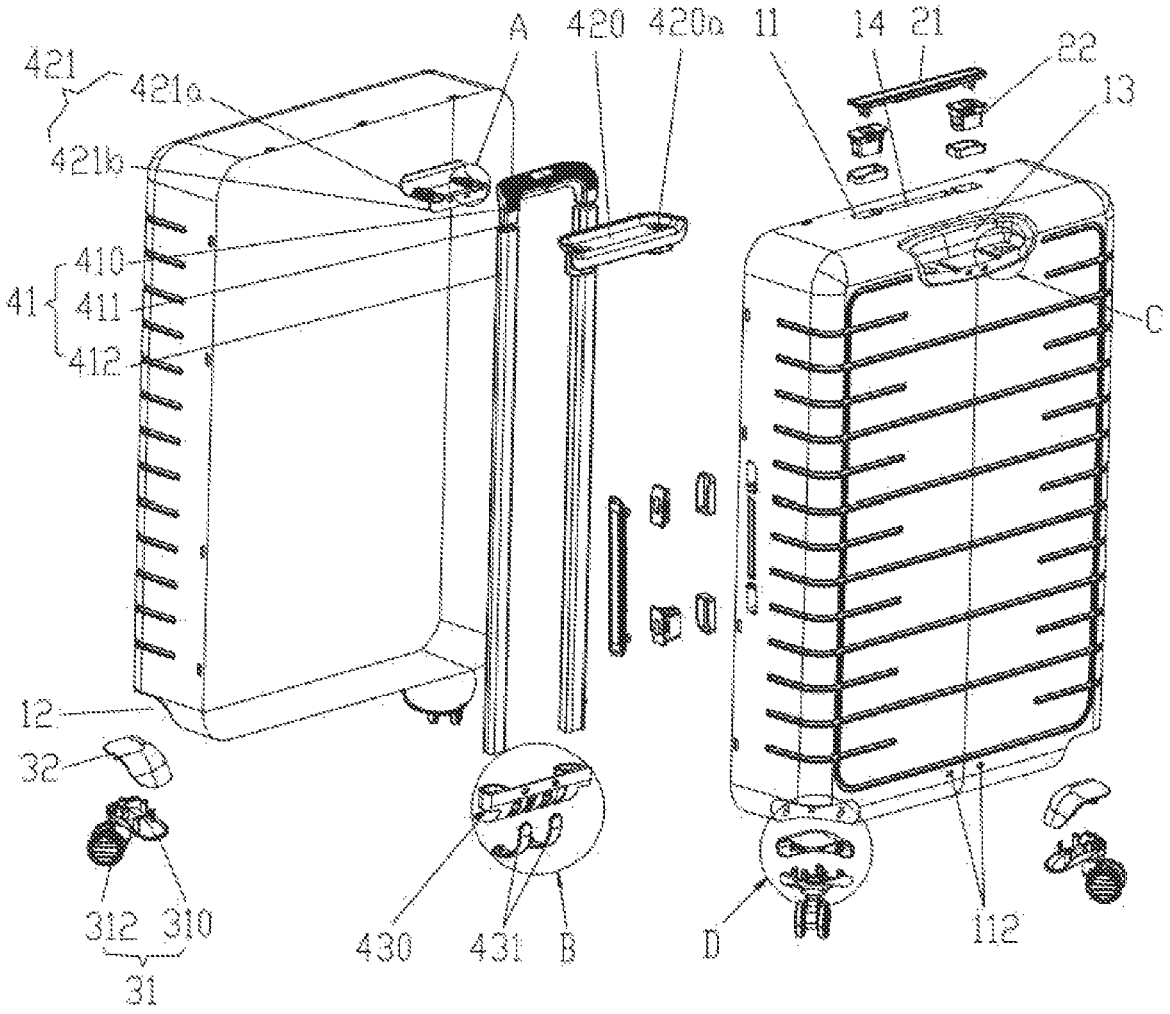
FIG. 2 is an exploded view of FIG. 1.
Figure 3:
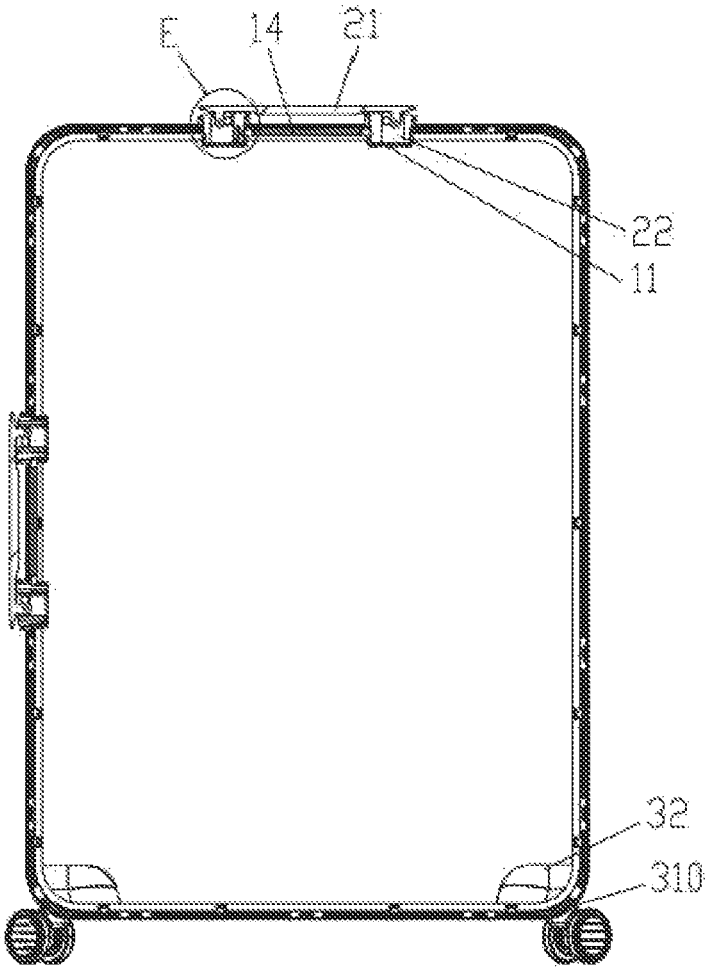
FIG. 3 is a sectional view of the quick assembling trolley case of FIG. 1 viewed from a first angle.
Figure 4:
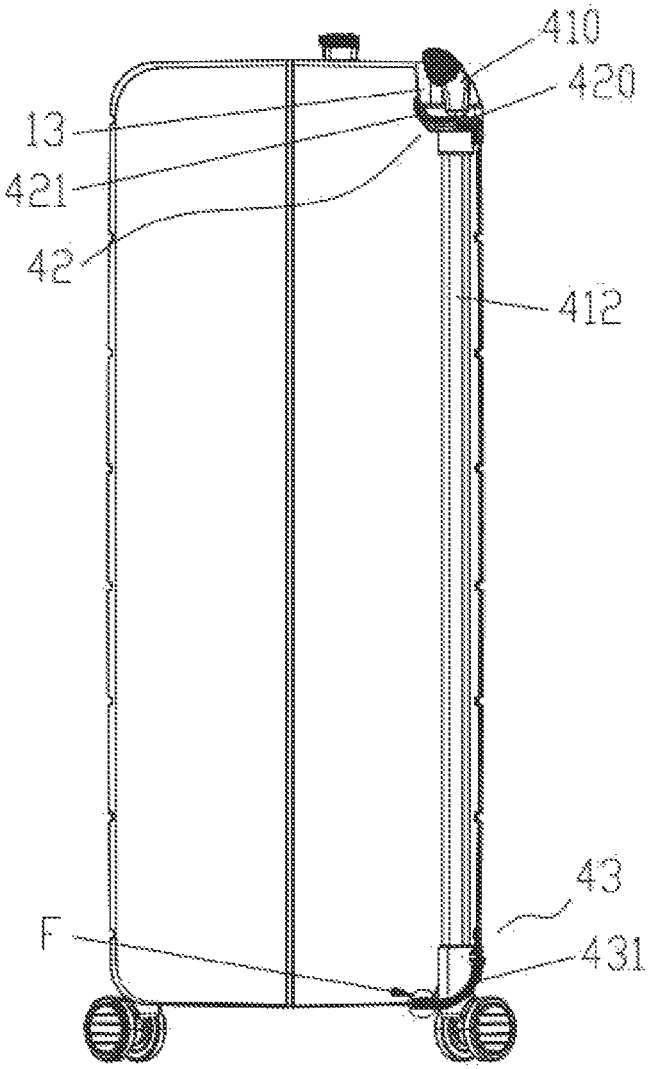
FIG. 4 is another sectional view of the quick assembling trolley case of FIG. 1 viewed from a second angle.
Figure 5:
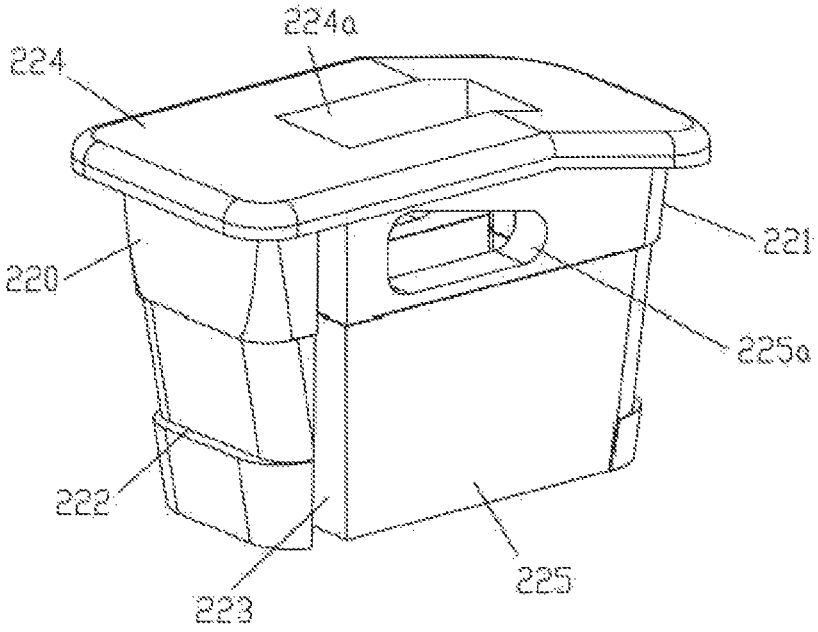
FIG. 5 is a perspective structural view of a handle fixing seat for the quick assembling trolley case of the present invention.

In the above described embodiment, as shown in FIGS. 2 and 3, the shell 10 is provided on a surface area between the two retaining recesses 11 with an elongated yield recess 14, such that a user's fingers can easily pass the elongated yield recess 14 to grip the handle 21 without undesirably colliding with the shell 10.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A quick-assembling trolley case, comprising a shell, a plurality of handle parts, four caster assemblies and a telescopic handle mechanism, being characterized in that:

the handle parts include a handle and two handle fixing seats connected to two ends of the handle, such that the handle is assembled between the two handle fixing seats; and a plurality of surfaces of the shell are provided with two retaining recesses that are corresponding to the handle fixing seats, so as the retaining recesses are snap-fitted by the handle fixing seats;

each of the caster assemblies includes a wheel and a locating upper cover, and the wheel including a mounting base and a swivel caster mounted to the mounting base; the shell being provided at each of four bottom corners with a mounting recess matching the mounting base; and the mounting base and the locating upper cover are respectively located at an inner side and an outer side of the mounting recess for being snap-joined with each other through a wall of the mounting recess; and the telescopic handle mechanism includes a telescopic handle, an upper fixing assembly, and a lower fixing assembly;

the upper fixing assembly including an outer fixing plate and a first inner fixing plate; a surface of the shell being provided with a receiving recess corresponding to the outer fixing plate; the outer fixing plate and the first inner fixing plate are respectively located in front of and behind the receiving recess for being snap-joined with each other through a wall of the receiving recess;

the lower fixing assembly including a second inner fixing plate and a plurality of outer fixing strips; the second inner fixing plate and the outer fixing strips are respectively located at an inner side and an outer side of the shell for being snap-joined with each other through the wall of the shell;

the telescopic handle including a grip, two movable rods connected to two ends of the grip, and two guiding sleeves fitted on around an outer sides of the two movable rods; and two lateral ends of the outer fixing plate being provided with a guiding hole respectively, and the guiding holes extending through the outer fixing plate and matching the guiding sleeves; two lateral ends of the receiving recess having a through hole corresponding to the guiding holes respectively; two lateral ends of the second inner fixing plate being provided with a locating hole respectively; and the guiding sleeves having bottom ends passing through the through holes and the guiding holes to insert into the locating holes.

2. The quick-assembling trolley case as claimed in claim 1, wherein each of the two handle fixing seats is provided at two opposite end surfaces with a first slant surface and a second slant surface; both of the first slant surface and the second slant surface being externally provided with a snap-fit recess, and each of the retaining recesses is provided with two first snap-fit protrusions on two opposing end walls for snapping joined to the snap-fit recess; each of the two handle fixing seats being further provided at two opposite side surfaces with a guiding groove, two opposing walls of retaining recesses are provided with a first guiding plate corresponding to the guiding groove; and the first guiding plate being located in and movably relative to the guiding groove.

3. The quick-assembling trolley case as claimed in claim 2, wherein the locating upper cover is provided on an inner side with a plurality of insertion members, and a wall surface of the mounting recesses is provided with a plurality of first penetrating slots at positions corresponding to the insertion members; each of the mounting bases being provided with a plurality of retaining members corresponding to the first penetrating slots, and each of the retaining members being provided with a penetrating insertion slot matching the insertion member; and an end of the insertion member being provided at two opposite sides with a plurality of second snap-fit protrusions, the second snap-fit protrusions sequentially pass through the first penetrating slots and the penetrating insertion slots to be retained to the penetrating insertion slots.

4. The quick-assembling trolley case as claimed in claim 3, wherein the outer fixing plate of the telescopic handle mechanism includes a first bottom portion matching a configuration of the receiving recess, and a first side portion downward extended from one side of the first bottom portion; the first side portion being parallelly provided on an inner side surface with a plurality of third snap-fit protrusions, and the first bottom portion having an underside located adjoining a wall surface in the receiving recess; the surfaces of the shell being provided with a yield recess communicable with the receiving recess, and the first side portion of the outer fixing plate being located in the yield recess; the wall of the yield recess being provided with second penetrating slots corresponding to the third snap-fit protrusions; the first inner fixing plate including a second bottom portion matching a configuration of an outer wall surface of the receiving recess, and a second side portion downward extended from one side of the second bottom portion; the second bottom portion having an underside located adjoining a wall surface outside the receiving recess, and the second side portion being provided with a plurality of first penetrating retaining slots corresponding to the second penetrating slots on the receiving recess; and the third snap-fit protrusions on the first side portion being inserted through the second penetrating slots to be retained to the first penetrating retaining slots on the first side portion.

5. The quick-assembling trolley case as claimed in claim 4, wherein the second inner fixing plate includes a third bottom portion matching a configuration of an inner wall surface of the shell, and two connecting portions symmetrically be provided at two lateral end of the third bottom portion; the locating hole is disposed on a top of the connecting portions; an inner side surface of the outer fixing strips is provided at each of two ends with a fourth snap-fit protrusion, and the shell being provided at lower positions corresponding to the fourth snap-fit protrusions with a plurality of third penetrating slots; and the third bottom portion being provided with second penetrating retaining slots corresponding to the third penetrating slots, and the fourth snap-fit protrusions extending through the third penetrating slots to be retained to the second penetrating retaining slots on the second inner fixing plate.

6. The quick-assembling trolley case as claimed in claim 5, wherein an underside of the first bottom portion is provided at two lateral ends with a guiding channel body, and the receiving recess is penetrated to form a horizontal penetrating slot that extends to the yield recess, so as the guiding channel is assembled with the horizontal penetrating slot; the second bottom portion being provided on a top side near each of two lateral ends with a recessed horizontal push groove that extends to the second side portion and is located corresponding to the guiding channel bodies, and the guiding channel bodies being movably located on the horizontal push grooves; the guiding channel bodies being respectively provided on a bottom with a penetrating elongated slot, and the horizontal push grooves being respectively provided on a top with a second guiding plate corresponding to the penetrating elongated slots, so that the second guiding plates are movably engaged with the elongated guiding slots; and the second guiding plates being respectively provided on a top with a limiting plate, and the limiting plates are movably set in the guiding channel bodies.

7. The quick-assembling trolley case as claimed in claim 6, wherein each of the handle fixing seats includes a top plate provided with a penetrating passage, and a fitting barrel connected to a lower side of the top plate, and two opposite side walls of the fitting barrel are provided with a wedge-shaped movement slot; and the handle being provided on a lower side at two opposite ends with a connecting lug each, each of the connecting lugs being provided with a through pin hole, and the through pin hole being connected between two wedge-shaped movement slots by a shaft pin.

8. The quick-assembling trolley case as claimed in claim 7, wherein the surface of the shell is provided with an elongated yield recess located between the two retaining recesses.

* * * * *